US010323347B2

(12) United States Patent
Hughes et al.

(10) Patent No.: US 10,323,347 B2
(45) Date of Patent: Jun. 18, 2019

(54) PALLET DRIVE SYSTEM FOR MOVING A WORK-PIECE

(71) Applicant: NIKE, Inc., Beaverton, OR (US)

(72) Inventors: Michael D. Hughes, Woodland, WA (US); YongSeon Lee, Hochiminh (VN); Son Thai Cao, Ho Chi Minh (VN); Hieu Q. Tran, Ho Chi Minh (VN); Edward F. Wachtel, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/509,096

(22) PCT Filed: Feb. 10, 2016

(86) PCT No.: PCT/US2016/017374
§ 371 (c)(1),
(2) Date: Mar. 6, 2017

(87) PCT Pub. No.: WO2016/130694
PCT Pub. Date: Aug. 18, 2016

(65) Prior Publication Data

US 2017/0284003 A1 Oct. 5, 2017

(30) Foreign Application Priority Data

Feb. 11, 2015 (VN) ..... 1-2015-00527

(51) Int. Cl.
*D05B 39/00* (2006.01)
*D05C 9/04* (2006.01)

(52) U.S. Cl.
CPC ..... *D05B 39/00* (2013.01); *D05C 9/04* (2013.01)

(58) Field of Classification Search
CPC ..... D05B 39/00; D05B 39/005; D05B 11/00; D05B 21/00; D05C 9/00–9/18
See application file for complete search history.

(56) References Cited

U.S. PATENT DOCUMENTS 2,726,613 A * 12/1955 Eddy ..... D05B 3/16 112/114
3,955,722 A * 5/1976 Bard ..... D05C 1/04 223/106

(Continued)

FOREIGN PATENT DOCUMENTS

CN 102889282 A 1/2013
EP 695604 A1 2/1996

(Continued)

OTHER PUBLICATIONS

PCT International Search Report and Written Opinion dated May 6, 2016 in U.S. Patent Application No. PCT/US2016/017374, 13 pages.

(Continued)

*Primary Examiner* — Ismael Izaguirre
(74) *Attorney, Agent, or Firm* — Shook, Hardy & Bacon L.L.P.

(57) ABSTRACT

A pallet drive system is provided that is operable for use on a sewing system. The pallet drive system has a pallet that is configured to hold a work-piece in position. A pair of alignment posts is coupled to the pallet. In exemplary aspects, each alignment post has a shape with surfaces extending in three dimensions along x, y and z axes. A corresponding pair of gripping fingers is coupled to a sewing machine, corresponding to each alignment post, that are moveable between an open position, allowing the alignment post to be positioned between the gripping fingers, and a closed position where the gripping fingers surround the (Continued)

alignment post. The gripping fingers define a cavity in the closed position to surround the alignment post in the x, y and z axes.

13 Claims, 4 Drawing Sheets

(56) References Cited

U.S. PATENT DOCUMENTS

| | | | | |
|---|---|---|---|---|
| 3,988,993 | A | 11/1976 | Brophy | |
| 4,870,917 | A * | 10/1989 | Frye | D05B 39/00 112/114 |
| 5,005,501 | A * | 4/1991 | Kita | D05B 21/00 112/102.5 |
| 5,074,230 | A * | 12/1991 | Morii | D05B 39/00 112/114 |
| 5,261,340 | A * | 11/1993 | Conley, Jr. | D05B 39/00 112/102.5 |
| 5,363,785 | A | 11/1994 | Conley | |
| 5,427,043 | A | 6/1995 | Conley et al. | |
| 5,630,370 | A * | 5/1997 | Herbach | D05C 9/04 112/103 |
| 7,194,966 | B2 * | 3/2007 | Tajima | D05C 9/04 112/103 |
| 2003/0030294 | A1 | 2/2003 | Michler et al. | |
| 2017/0284003 | A1 | 10/2017 | Hughes et al. | |

FOREIGN PATENT DOCUMENTS

| | | | |
|---|---|---|---|
| GB | 2141097 | A | 12/1984 |
| JP | 2015066386 | A | 4/2015 |
| WO | 9217632 | A1 | 10/1992 |
| WO | 2015134263 | A1 | 9/2015 |

OTHER PUBLICATIONS

International Preliminary Report on Patentability dated Aug. 24, 2017 in International Patent Application No. PCT/US2016/017374, 9 pages.

Communication pursuant to Article 94(3) dated Oct. 19, 2018 in European Patent Application No. 16709173.5, 4 pages.

* cited by examiner

PALLET DRIVE SYSTEM FOR MOVING A WORK-PIECE

CROSS-REFERENCE TO RELATED APPLICATIONS

This application claims priority under 35 U.S.C. § 371 to PCT/US2016/017374, filed on Feb. 10, 2016, entitled "Pallet Drive System for Moving a Work-Piece," which claims priority to Vietnamese Patent Application No. 1-2015-00527, filed Feb. 11, 2015, entitled "Pallet Drive System for Moving a Work-Piece," the entirety of the aforementioned applications is incorporated by reference herein.

BACKGROUND OF THE INVENTION

Industrial sewing machines exist that move a work-piece relative to a sewing needle using a pallet drive system. The pallet maintains the work-piece(s) in position, and the drive system moves the pallet, and thus the work-piece, relative to the sewing needle. Oftentimes, however, these drive systems fail to accurately position the work-piece. Additionally, existing pallet drive systems are expensive.

SUMMARY OF THE INVENTION

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. The present invention is defined by the claims.

At a high level, aspects herein relate to a pallet drive system operable for use on a sewing system having a sewing head, with a sewing needle operable to perform a sewing operation on a work-piece. The sewing system has a mounting horn that operates to move the work-piece relative to the sewing needle. The pallet drive system has a pallet that is configured to hold the work-piece in position. A pair of alignment posts is coupled to the pallet. In exemplary aspects, each alignment post has a shape with surfaces extending in three dimensions along x, y and z axes. The mounting horn has a corresponding pair of gripping fingers coupled thereto, for each alignment post, that are moveable between an open position, allowing the alignment post to be positioned between the gripping fingers, and a closed position where the gripping fingers surround the alignment post. The gripping fingers define a cavity in the closed position to surround the corresponding alignment post in the x, y and z axes. Therefore, as the mounting horn moves, the movement of the work-piece, through the pallet, is moved correspondingly.

The configuration of the above-described pallet drive system provides for several advantages. As just one example, and without limitation, the gripping fingers more-accurately position the pallet and the work-piece by surrounding the alignment post in three dimensions. As another example, the gripping fingers are symmetrically designed to allow them to be used interchangeably as either a left or right-side finger.

BRIEF DESCRIPTION OF THE DRAWING

Examples are described in detail below with reference to the attached drawing figures, wherein.

DETAILED DESCRIPTION OF THE INVENTION

Aspects herein relate to a pallet drive system operable for use on a sewing system having a sewing head, with a sewing needle operable to perform a sewing operation on a work-piece. The sewing system has a mounting horn that operates to move the work-piece relative to the sewing needle. The pallet drive system has a pallet that is configured to hold the work-piece in position. A pair of alignment posts is coupled to the pallet. In exemplary aspects, each alignment post has a shape with surfaces extending in three dimensions along x, y and z axes. The mounting horn has two corresponding pairs of gripping fingers coupled thereto that are moveable between an open position, allowing the alignment posts to be positioned between the gripping fingers, and a closed position where the gripping fingers surround the alignment post. The gripping fingers define a cavity in the closed position to surround the corresponding alignment post in the x, y and z axes. This configuration accurately and repeatably positions the work-piece, through the pallet, relative to the mounting horn and sewing needle.

Figure 1:
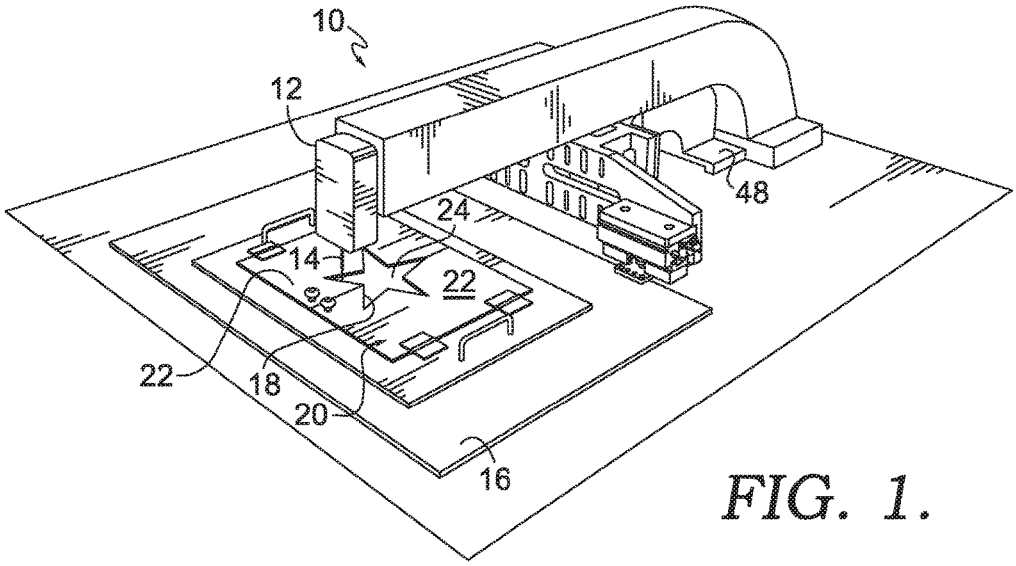
FIG. 1 illustrates a perspective view of an exemplary pallet drive system in accordance with aspects hereof.

FIG. 1 depicts an exemplary sewing system 10 that will be described for reference purposes. Industrial sewing machines have a sewing head 12 that operates a reciprocating sewing needle 14. The sewing system 10 operates to move a pallet 16 relative to the sewing needle. The pallet 16 typically has a pattern 18 formed in it, as well as an access window 20. Access window 20 can be, for example, a pair of hinged doors 22 coupled to the pallet, and forming a part of the pallet. The access window 20 is used to position one or more work-pieces 24 within the access window 20. The hinged doors 22 are then held in a closed position to retain the work-pieces 24 in the proper position. Other mechanisms for positioning and holding the work-pieces 24 can also be used.

Figure 2:
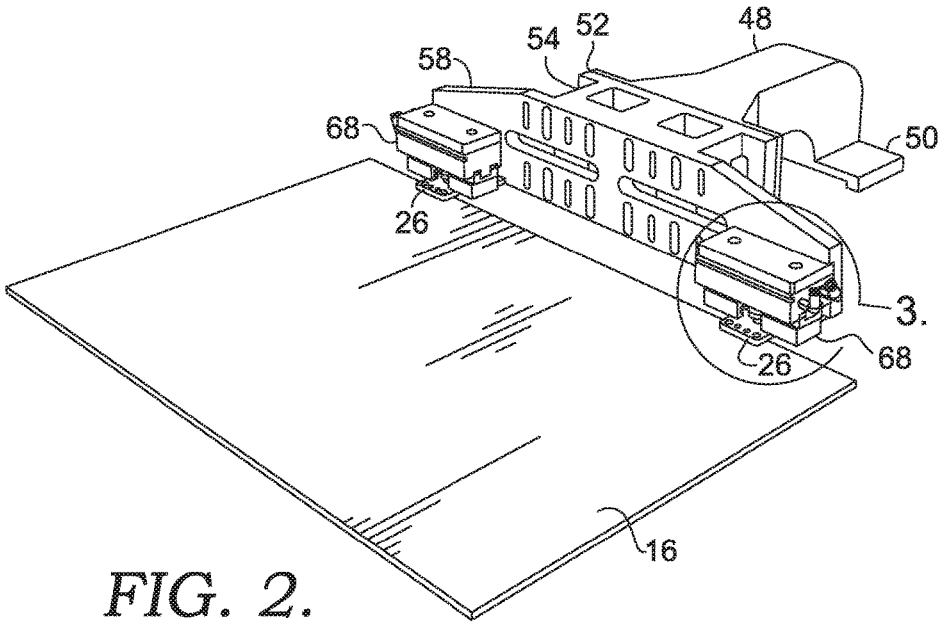
FIG. 2 is a simplified view similar to FIG. 1 with certain parts omitted for clarity.
Figure 3:
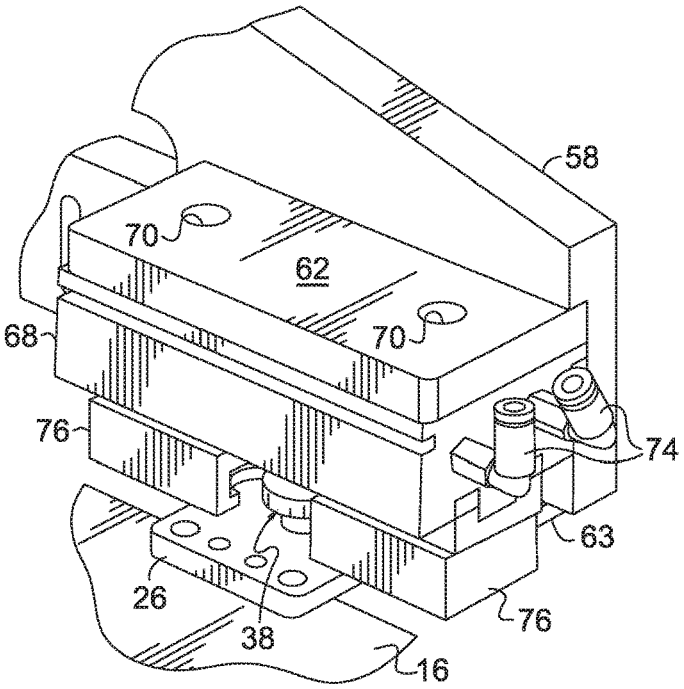
FIG. 3 provides an enlarged view of the encircled region of FIG. 2.
Figure 6:
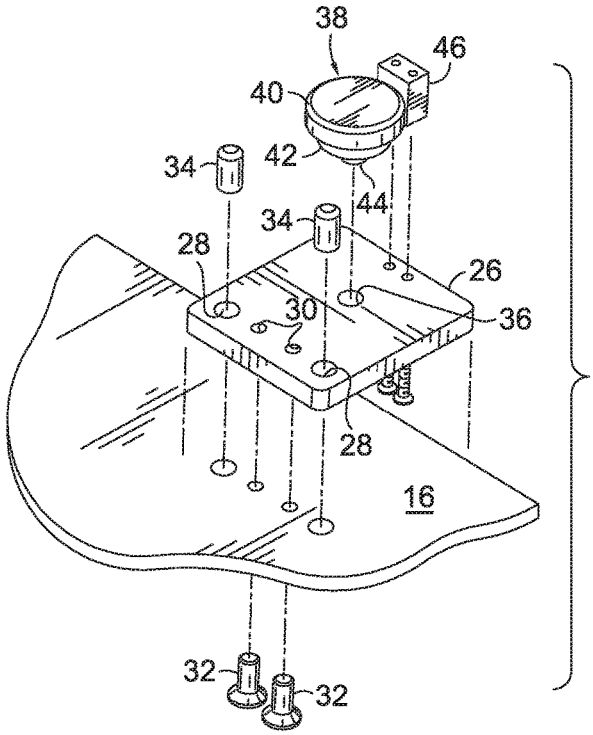
FIG. 6 provides an exploded view of selected components.

As best seen in FIGS. 2, 3 and 6, the pallet 16 includes a pair of post-holders 26. FIG. 2 illustrates only portions of the pallet and sewing system to more completely show other portions. As seen in FIG. 6, each post holder 26 has a pair of locating holes 28, and a pair of threaded bolt holes 30. The locating holes 28 are used with a pair of corresponding locating holes 31 on pallet 16 and dowel pins 34 to precisely locate the post-holders 26 on pallet 16. The bolt holes 30 are used, along with corresponding holes 33 in post holder 26, and bolts 32 to couple the post-holders to the pallet 16. It should be understood that other location and connection mechanisms could also be used.

As best seen in FIG. 6, each post-holder 26 also includes a post-hole 36. With continued reference to FIG. 6, an alignment post 38 is press-fit into the post holder 26.

Alignment post 38 has an upper section 40, a lower section 42 and a locating pin 44. The upper section 40, in one aspect is a disc-shape; with the lower section 42 extending from the upper section, and being of a smaller-diameter disc-shape. The locating pin 44 extends from lower section 42, and is precisely shaped and sized to be press-fit into the post hole 36 in post holder 26. Other attaching mechanisms could also be used to couple alignment post 38 to post holder 26.

In some aspects, a sensor flag 46 is also coupled to the post holder 26 near alignment post 38 using bolts or screws 39. Sensor flag 46 is used to determine when the pallet 16 and work-piece 24 are in position and ready to be sewn, as further described below. In other aspects, portions of the pallet 16, post holder 26 or alignment post 38 could also be used as the object of detection.

As noted above, the sewing system 10 moves the pallet 16 relative to the sewing needle 14. As best seen in FIGS. 1 and 2, typically, the sewing head 12 includes a horn, or drive head, 48. The horn 48 is coupled to the sewing machine, and moves according to the desired stitching path needed for the work-piece 24. The horn 48 has a back end 50 coupled to the drive system of the sewing machine, and a mounting face 52. The mounting face 52 is configured with a number of mounting holes which are used to couple the remaining attachment components described below.

Figure 4:
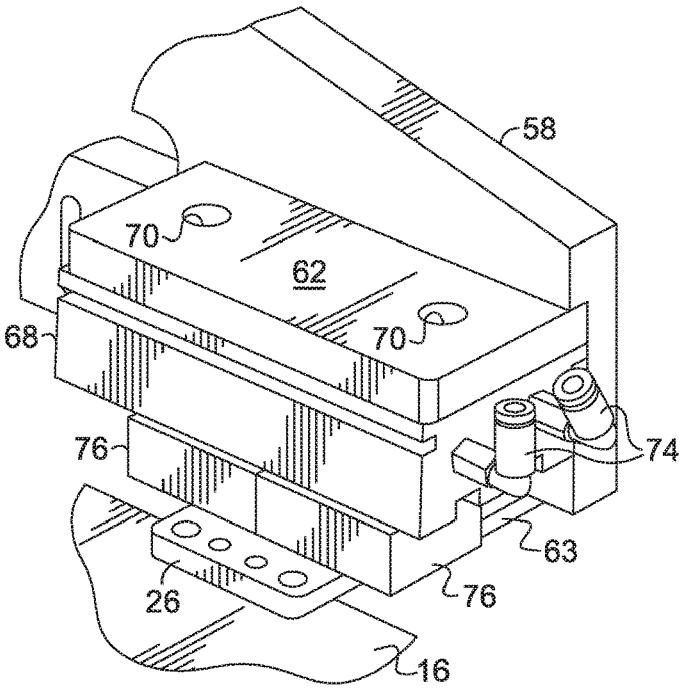
FIG. 4 is a view similar to FIG. 3, showing the gripping fingers in a closed position.
Figure 5:
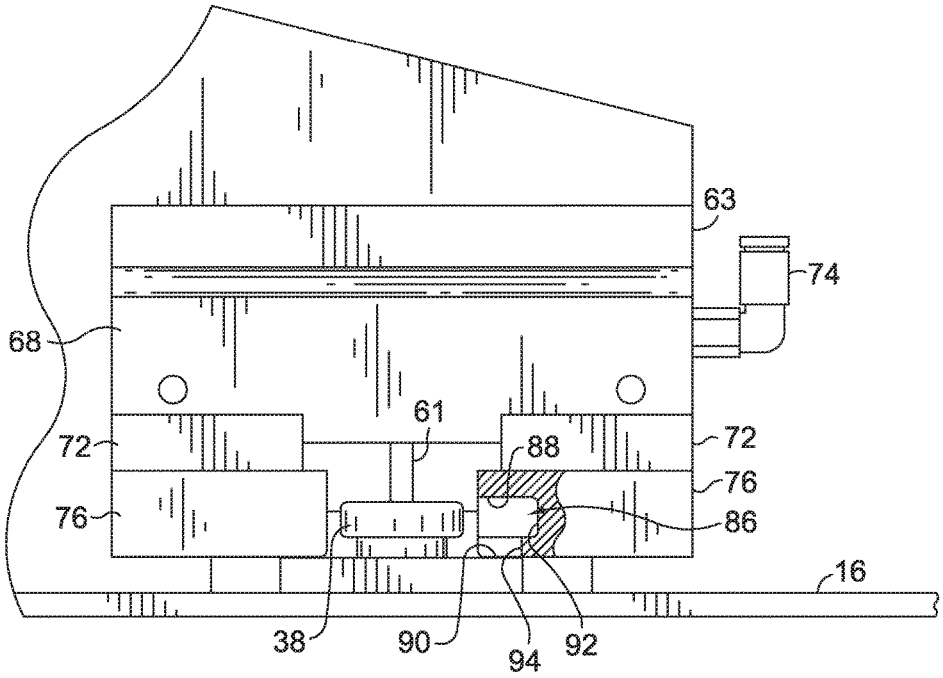
FIG. 5 provides a partial front plan view of the area of FIG. 2, with parts being broken away to show particular details of construction.

A yoke 54 is coupled to the horn 48 using at least some of the mounting holes on face 52. As one example, the yoke 54 may be coupled to the horn 48 using a number of bolts. The yoke 54 supports and positions a spacer plate 58. The spacer plate 58 may be coupled to the yoke 54 using a number of bolts. Other coupling mechanisms, beyond the bolts, may be used to couple the horn 48, yoke 54 and spacer plate 58. In an exemplary aspect, the yoke 54 and spacer plate 58 are made from a suitable steel material, although other materials could be used as well. The horn 48, yoke 54 and spacer plate 58 are rigidly secured together, such that no relative movement between the parts is allowed. As best seen in FIG. 5, a proximity sensor 61 is coupled to spacer plate 58. As more-fully described below, proximity sensor 61 is configured to detect the presence of the sensor flag 46, indicating the pallet 16 is in position and ready. As noted above, in alternative aspects, the sensor 61 could also be positioned and configured to detect the proper position of the pallet 16, such as the post holders 26 or the alignment post 38. As partially seen in FIGS. 3 and 4, a bracket 63 may be coupled to spacer plate 58 to protect the sensor 61 from damage, such as by contact from adjacent parts. If used, bracket 63 is rigidly coupled to spacer plate 58, such as by bolting or other attachment mechanisms.

As best seen in FIGS. 2 and 3, a bracket 62 is also positioned on spacer plate 58. The bracket 62 is held on spacer plate 58, such as through a number of bolt holes in spacer plate 58 and corresponding bolts. The bracket 62 extends forwardly from the spacer plate 58 opposite the yoke 54. The bracket 62 is sized to hold a gripper mechanism 68 in the proper position. The gripper mechanism 68 is rigidly coupled to the bracket 62, such as with a pair of bolts 70. Alternatively, the gripper mechanism 68 may be secured directly to the spacer plate 58. Like the yoke 54 and spacer plate 58, the bracket 62 is preferably made from a suitable steel material, although other materials could be used. The gripper mechanism 68 has a pair of reciprocating jaws 72 that operate to move toward and away from one another. The jaws 72, in an exemplary aspect, are pneumatically operable to open and close. A pair of ports 74 is provided in gripper 68 to selectively provide air pressure to open and close the jaws 72. Alternatively, the jaws may be biased to either the open or closed position, such as by spring pressure, and pneumatic pressure is applied to overcome the biasing force to either open or close the jaws. Commercially available parallel grippers may be used, such as those available from the De-Sta-Co company of Auburn Hills, Mich.

Figure 7:
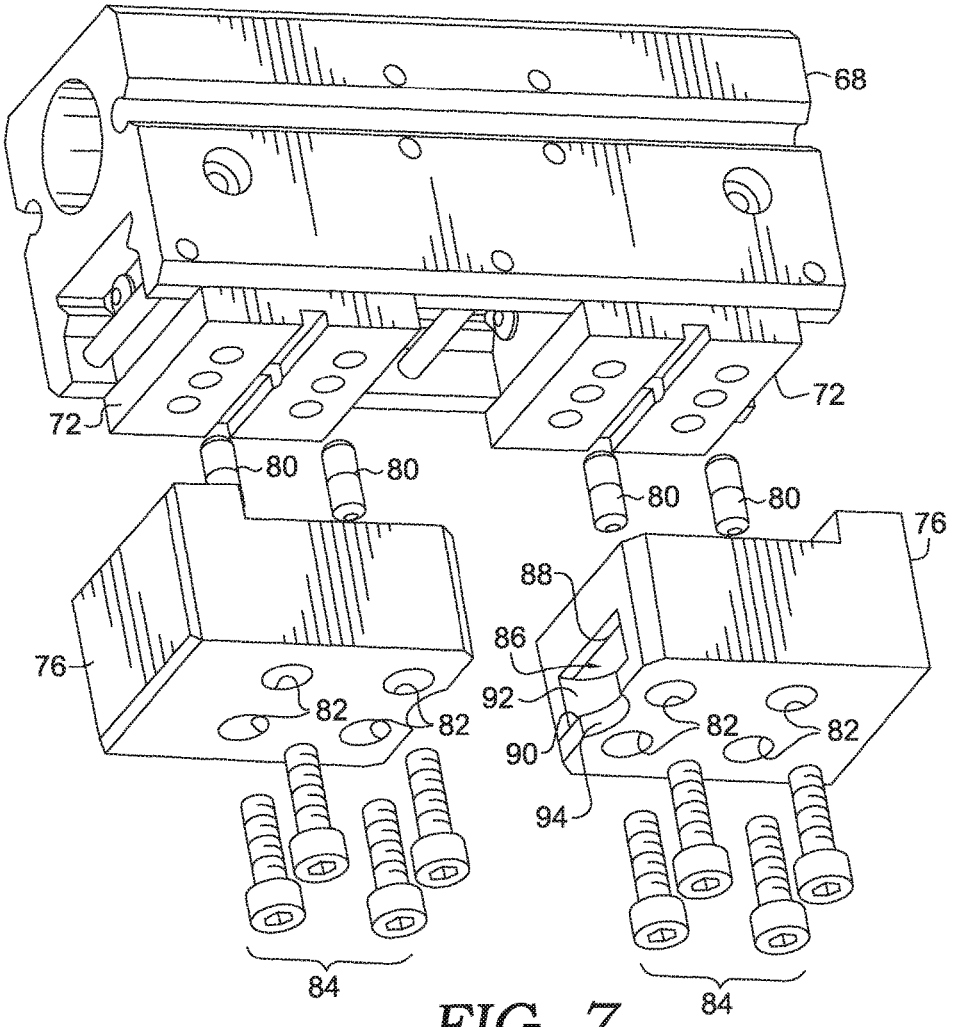
FIG. 7 provides an exploded view of the gripper and gripping fingers.

As best seen in FIGS. 5 and 7, a gripping finger 76 is positioned on each jaw 72. Preferably, each finger 76 has a pair of locating holes that are used in combination with a pair of dowel pins 80 to position the finger 76 on the jaw 72. Each finger 76 also has a number of bolt holes 82 that are used, in combination with bolts 84, to rigidly secure the finger 76 to the jaw 72 using corresponding threaded holes in jaw 72. As the jaws 72 reciprocate open and closed on gripper 68, the fingers 76 correspondingly reciprocate open and closed. Each finger 76 has a cavity 86. Cavity 86 is shaped and sized to capture the alignment post 38 when the pallet 16 is moved into a position to stitch the work-pieces 24. In one aspect, cavity 86 is shaped as a semi-circle having a height corresponding to the height of the upper section 40 of alignment post 38. Each cavity 86 thus has an upper surface 88, a lower surface 90 and in inner, arcuate surface 92 having a radius corresponding to the radius of upper section 40 of alignment post 38. Immediately below lower surface 90, finger 76 has a lower arc face 94 that has a radius corresponding to the lower section 42 of alignment post 38. The shape and size of cavity 86 and lower arc face 94 thus allow the material of finger 76 around cavity 86 and lower arc face 94 to completely surround alignment post 38 when the fingers 76 are moved to the closed position shown in FIG. 4. Preferably, each finger is usable as either the left or right finger, the left and right fingers being mirror-images of one another. Such a construction allows the fingers 76 to be used interchangeably and reduces the overall costs of the system.

In use, one or more work-pieces 24 are placed within the pallet 16 using the hinged doors 22 to open the access window 20. The pallet 16 is then moved into place for sewing, moving the alignment posts 38 between the open fingers 76, as shown in FIGS. 2 and 3. When the alignment posts 38 are in this position, the proximity sensor 61 detects the presence of the pallet through the sensor flags 46 (or in other aspects, the post holders 26 or alignment posts 38). In this position, the system uses a logic controller to signal the gripper 68 to move the jaws 72, and thus the fingers 76, to the closed position shown in FIG. 4. In the closed position, the cavities 86 of mating fingers 76 enclose the alignment post 38. The fingers 76, through the cavities 86 retain the alignment posts 38 in position with multiple contact surfaces in a three-dimensional fashion in the x, y and z directions. The accurate and precise positioning of the post holder 26 on pallet 16, along with the accurate and precise positioning of each alignment post 38 on post holder 26, coupled with the positive positioning achieved with fingers 76 allows for a repeatable, reliable positioning of the work-pieces 24 relative to the sewing needle 14. Additionally, by providing a pallet 16 with post holders 26 and alignment posts 38 consistently positioned on the pallet 16, the pallet 16 is usable on different sewing systems 10, provided they are equipped with the above-described yoke 54, spacer plate 58, gripper 68 and fingers 76.

Many different arrangements of the various components depicted, as well as components not shown, are possible without departing from the scope of the claims below. Aspects of our technology have been described with the intent to be illustrative rather than restrictive. Alternative aspects will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A pallet drive system for a sewing system, the sewing system having a sewing head with a sewing needle operable to perform a sewing operation on a work-piece, and a mounting horn operable to move the work-piece relative to the sewing needle, the pallet drive system comprising:

a pallet adapted to hold the work-piece in position;

a pair of alignment posts spaced from one another and coupled to the pallet, each alignment post having surfaces extending in three-dimensions along x, y and z directions; and at least two pairs of gripping fingers operably coupled to the mounting horn, and each pair of gripping fingers spaced to correspond to the spacing of the alignment posts on the pallet, each pair of gripping fingers moveable between an open position and a closed position, the gripping fingers defining a cavity in the closed position configured to surround a corresponding alignment post in the x, y and z directions.

2. The pallet drive system of claim 1, wherein each alignment post has a first lower section having a generally cylindrical shape, and a second upper section having a generally cylindrical shape, the first section having a diameter less than the second section.

3. The pallet drive system of claim 2, wherein the defined cavity of each pair of the gripping fingers has a shape corresponding to the shape of the first and second sections of the alignment post.

4. The pallet drive system of claim 3, wherein each gripping finger of a pair of gripping fingers is a mirror-image of the other, such that the fingers are interchangeable.

5. The pallet drive system of claim 4, wherein the alignment posts are coupled to the pallet using a pair of post-holders, each of the post holders being secured to the pallet, and each alignment post being coupled to a corresponding post holder.

6. The pallet drive system of claim 5, wherein the post holders are secured to the pallet using a pair of dowel pins.

7. The pallet drive system of claim 6, further comprising a sensor flag coupled to each post holder, and a corresponding sensor coupled to the mounting horn, the sensor positioned on the post holder to indicate proximity to the mounting horn when the pallet is in position to close the gripping fingers.

8. A pallet drive apparatus for a sewing machine, the sewing machine having a sewing head with a sewing needle operable to perform a sewing operation on a work-piece held within a pallet, the pallet having a pair of spaced apart alignment posts, and a mounting horn operable to move the pallet and work-piece relative to the sewing needle, the pallet drive apparatus comprising:

a yoke coupled to the mounting horn;

a spacer plate coupled to the yoke; and two spaced apart sets of gripping fingers, each set operably coupled to the spacer plate and positioned to engage the alignment posts of the pallet, each set of gripping fingers moveable between an open position and a closed position, the gripping fingers defining a cavity in the closed position configured to surround a corresponding alignment post in the x, y and z directions.

9. The pallet drive apparatus of claim 8, wherein the cavity of each set of gripping fingers corresponds in shape to the shape of the alignment posts.

10. The pallet drive apparatus of claim 9, wherein the cavity surrounds elements of the alignment post in x, y and z directions.

11. The pallet drive apparatus of claim 10, further comprising a pair of proximity sensors coupled to the spacer plate and positioned to detect proximity of the alignment posts to indicate the work-piece is in position for closing the gripping fingers prior to sewing.

12. A pallet for a holding a work-piece in place relative to a drive apparatus for a sewing machine, the sewing machine having a sewing head with a sewing needle operable to perform a sewing operation on the work-piece, and a mounting horn operable to move the pallet and work-piece relative to the sewing needle, the mounting horn having a pair of grippers coupled thereto to engage the pallet, the pallet comprising:

a frame;

an access window defined in the frame, sized to allow the work-piece to be placed within the access window;

two spaced apart alignment posts coupled to the frame and positioned to correspond to the location of the grippers, each alignment post having surfaces extending in three dimensions along the x, y and z directions;

a pair of post-holders, each post-holder coupled between the pallet and a corresponding alignment post; and a sensor flag coupled to each post holder, and a corresponding sensor coupled to the mounting horn, the sensor positioned on the post holder to indicate proximity to the mounting horn when the pallet is in position to close the gripping fingers.

13. The pallet of claim 12, wherein the alignment posts each have a first lower section having a generally cylindrical shape, and a second upper section having a generally cylindrical shape, the first section having a diameter less than the second section.

* * * * *